US007125299B1

(12) United States Patent
Ross, Jr.

(10) Patent No.: US 7,125,299 B1
(45) Date of Patent: Oct. 24, 2006

(54) HAND HELD PADDLES FOR UNDERWATER MOVEMENT

(76) Inventor: Patrick L. Ross, Jr., P.O. Box 362, Oakland, CA (US) 94528

( * ) Notice: Subject to any disclaimer, the term of this patent is extended or adjusted under 35 U.S.C. 154(b) by 0 days.

(21) Appl. No.: 10/908,697

(22) Filed: May 23, 2005

(51) Int. Cl.
*A63B 31/10* (2006.01)

(52) U.S. Cl. ..... 441/56; D21/807
(58) Field of Classification Search ..... 441/56, 441/55, 58; D21/807
See application file for complete search history.

(56) References Cited

U.S. PATENT DOCUMENTS 1,066,696 A 7/1913 Baker
1,413,967 A 4/1922 Clarke
1,540,368 A 6/1925 Samuels
1,971,844 A * 8/1934 Babbitt ..... 441/58
2,159,972 A 5/1939 Larson
2,745,119 A * 5/1956 Whipple ..... 441/56
2,810,138 A 10/1957 Cochran
5,167,551 A 12/1992 Davis
5,348,503 A 9/1994 Fechtner
5,643,027 A 7/1997 Evans et al.
5,842,896 A 12/1998 Liveoak

FOREIGN PATENT DOCUMENTS

FR 2607019 A1 * 5/1988

* cited by examiner

*Primary Examiner*—Jesús D. Sotelo

(57) ABSTRACT

A device for facilitating rapid movement beneath the surface of water is disclosed, having a hand held paddle for each hand, each paddle having an outboard tip and a tail, and a downward facing concave surface with a radius of curvature in a zone near the tip greater than the radius of curvature in a zone near the tail of each paddle.

11 Claims, 6 Drawing Sheets

HAND HELD PADDLES FOR UNDERWATER MOVEMENT

FIELD OF THE INVENTION

This invention relates to a handheld diving aid for underwater movement. It has been found that locomotion beneath the surface of water entails different configurations for optimum performance than when surface movement is contemplated with at least part of the movement path above the surface being traversed. That is, the resistance of movement in a uniform body of water is stronger that the resistance encountered when the movement path is partially in air, above the body of water.

For centuries, the hull design of submarines resembled the hull designs of surface vessels because it was assumed that the hull moving partially submerged and partially above the water surface behaved the same way under water as on the surface of water. A generation ago, it was discovered from observing the movement of sea creatures under water that they could move much faster than expected because the configuration enabled even flow over the entire body of the sea creature, as contrasted to movement on the surface, where at least part of the body was above the surface of the water. Submarine hull design underwent drastic modification, with the current design more closely resembling that of sea creatures that move rapidly under the surface of water.

Foot mounted swim aids are effective for increased speed because most of the power stroke is with the foot totally submerged in water, as opposed to partially above the surface and partially below the surface, as a swimmers arms and hands normally move. Most hand or arm mounted swim aids are designed to merely enlarge the surface area encountering the water, as compared to the surface area of the swimmer's unaided hand. The enlarged surface area tends to oppose the surface movement during the return stroke as the swimmer's arm is extended forward in preparation for the power stroke.

Observers of the hydrodynamics of sea turtles (order Testudinata) have found that they travel at extremely fast speeds under water, as compared to their notoriously slow movement on land. Given that sea turtles carry their dwellings with them, it is counterintuitive that they would be such rapid swimmers. It is believed that the configuration of the forward limbs or fins of the sea turtle facilitate rapid movement.

The prior art reflects what inventors perceive to be the optimum configuration for propulsion under water, rather than a Darwinian observation of what actually works. Thus, U.S. Pat. Nos. 183,045; 950,633; 1,066,696; 1,413,967; 1,540,368; 2,159,972; 2,810,138 and 5,842,896 all show more or less symmetrical, cup-shaped paddles intended to enter the water during the power stroke forcing water to flow in a direction opposite to the direction of propulsion and to generally conform to the open hand. It is counterintuitive to have a paddle with an outwardly extending narrow tip at the forward end of a paddle, away from the body of the user, and a shorter radius of curvature at the forward end of the paddle than at the aft end. And yet the evolution of the turtle has resulted in just such a nonobvious configuration that affords faster, sleeker, and less turbulent motion under water. There is a need for a handheld paddle that is asymmetrical, faster, sleeker and less turbulent than prior art paddles.

SUMMARY OF THE INVENTION

The present invention seeks to emulate the forward extremities of sea turtles in providing a curvature that provides optimum displacement during the power stroke for forward movement of the user, while providing minimum displacement during the return stroke to minimize the impediment to forward movement. A series of arcs of different radiae in the hand-mounted diving aid permit cupping of water not unlike the human hand, where there is a curvature transversely from thumb to little finger, as well as longitudinally from heel to fingertips. Another curvature in the present diving aid is at the forward end of the paddle extending far beyond the little finger to a point outward from the user's body and forward to a point well ahead of the user.

These curvatures do not simply copy the end product in the evolution of turtles as swimmers and divers. Instead, they permit the optimum displacement of water by directing the front point of the paddle to a location well ahead of the user's body at the beginning of the power stroke.

As the user pulls the paddle rearwardly cupping water by holding the hand and the paddle perpendicular to the body, the curvature on the inside of the paddle permits displacement of water away from the user's body and the paddle with continued displacement until the user's hand is extended to the maximum limit at the thigh of the user. The user then turns each hand to expose the minimum dimension of the paddle to the water flow and raises the hand and paddle to slice through the water with a minimum of resistance parallel to the user's body. The curvature of the swim aid as it passes in the return stroke resembles the curvature of the user's body so that there is a minimum amount of turbulence. When the arm is extended to full reach forward of the user, the paddle is pointed away from the user to cup water for the next power stroke.

The invention is particularly useful, but is not limited to, diving in water. When a user dives below the surface of water, the hands and paddles never encounter air, and all power and return strokes are under water, as when a turtle swims.

PREFERRED EMBODIMENTS

Figure 1:
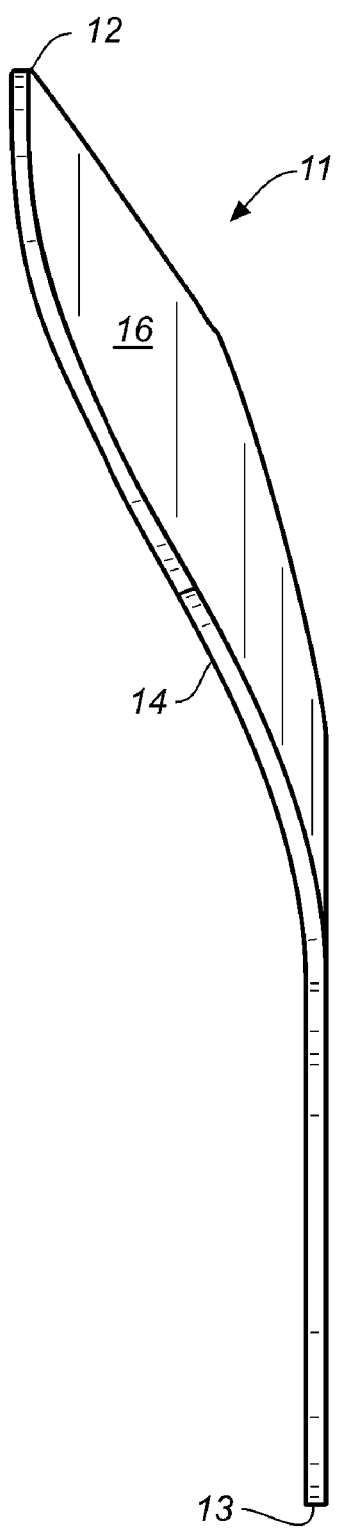
FIG. 1 is a left side elevation view of the right hand paddle.

Abalone are rock-clinging gastropod mollusks that are highly prized for their delicious flesh as well as for their mother of pearl shells. Over fishing for centuries has caused governments in the United States and elsewhere to severely regulate abalone hunting. No oxygen tanks may be used for extended stays under water while searching for deep abalone. The number of abalone caught per day is limited, and the size of each abalone must meet minimum requirements. As a result of these environmental protections, abalone hunters must dive unaided by any breathing apparatus, locate an abalone, pry it from the rock to which it clings, and return for air to the surface within the period that the hunter can hold his or her breath. At least in California, where I reside, wardens patrol constantly and issue severe sanctions for anyone violating the strict rules to protect abalone.

have found that by using the present invention, I am able to descend and ascend much more rapidly than without the paddles because the paddles displace much more water than do the unaided hands. This allows deeper dives to levels below where abalone hunters normally can descend. The abalone are larger and more plentiful at deeper levels. Also, quick descents and ascents mean more time for prying off abalone. The abalone flesh is a single large muscle that securely holds the abalone to its rock habitat. The paddles of this invention are no more intrusive on the abalone habitat than are masks and foot mounted flippers that facilitate the diving experience. I have found that I can descend to a depth of fifty feet using the paddles, retrieve an abalone, and ascend on a single deep breath.

Because prying the abalone from its habitat takes two hands usually, when the desired abalone is selected, I release both paddles from my hands to free them for the retrieval task. The lanyard on each paddle keeps the paddles attached to the wrists and within reach when ascent is required. After the abalone is freed from its habitat and secured in a container, I grasp each paddle with the index, middle and ring fingers of each hand in a notch on the outboard side of the paddle for rapid ascent without gripping the paddle in the usual preferred mode.

Another useful embodiment for the invention is for water therapy. The swim aids of this invention offer more resistance to water displacement in that the enlarged "cup" holds more water than a hand does when pulled against standing water. This means that greater muscular effort is required by the user than when the unaided hand is cupped to move water. The greater the resistance, the better the workout, as in weight training. Not only is the exercise better, it is more enjoyable to move more rapidly under water than one can move with the unaided hands. Particularly for the elderly, a paddle that promotes performance superior to that of much younger swimmers enhances self-esteem.

The paddles are useful in swimming movements, preferably with the paddles under the surface of water. A breast stroke motion is what the seven species of sea turtles use when swimming under water. The fins are extended forward to the greatest extent, then cupping water end pulling rearwardly enables the turtle to swim rapidly and efficiently. A human can swim backwards by having the swimmer's head out of water, his torso facing upward, his arms extended back with the paddles cupped to pull water toward the swimmer's feet, and pulling to propel the swimmer backwards. The paddles should not come out of the water.

Yet another preferred embodiment is to provide a rotational movement during the power stroke to simulate the forward thrust of a ship's propeller. Instead of pulling straight back on the power stroke, I find that one or a series of three or four rotational movements of the wrist and paddle give enhanced performance in forward thrust. At the start of the power stroke, the forward point of each paddle is rotated inwardly by the wrist to enable the point to cut through the water, beginning at the narrowest point of the paddle and pulling more and more water into the concave "cup" of the paddle as the elbows bend and the hands retract from ahead of the swimmer. When the paddle is fully engaged in pulling water rearwardly, the swimmer rotates the wrists outwardly, creating a whirl on each side as the paddle rotates through the water. This resembles the motion of twin propellers on a ship, each one rotating outwardly from the body passing through the water. However, the wrist cannot rotate through 360 degrees, as a ship's propellers do, so the user must gradually rotate the wrist inwardly as far as convenient, then commence another cycle of outward rotation to create another whirl as the arms proceed in a rearward direction. If the power stroke also includes three or four whirl formations during the pulling of the paddles rearwardly, even better performance can be attained than with a straight rearward pull.

The whirling motion is also useful when swimming backwards. By rotating both wrists outwardly then inwardly while pulling, creating whirls on each side, the speed of movement through the water is improved.

The straight pull technique (where both arms are extended forward of the swimmer's body and the power stroke extends straight back along the sides of the swimmer to the maximum extent beside the thighs before the return stroke) is usually optimum for descent and ascent in a dive where the swimmer holds his or her breath to descend as far as possible and rise as fast as possible, many other strokes can be facilitated with the paddles of this invention, so long as the paddles are kept under the surface of the water. Cruising at relatively slow speed can be accomplished with little effort by moving the hands and paddles in a figure 8 motion, forming a pattern in the water resembling the symbol for infinity. The rearward motion pulls water and the rotation of the wrists in the return stroke serves to slice through the water without impeding forward motion. The swimmer may be on his or her back or front with this motion, with the hands and paddles beneath the surface of the water. The power portion of this motion, when the swimmer is upright, is to pull the water in an outward movement with the wrists turned inward in order to make water flow around and down as the wrists are rotated outwardly. The return stroke begins with the wrists turned inwardly and the hands and paddles moved across and upwardly with minimum water resistance.

This figure 8 motion is also useful to provide stability in heavy surf or water surges. It resembles the side fin movements of fish treading water in riding a wave for stability.

The usual swimming strokes like the crawl and the breast stroke are enhanced by the use of the paddles of this invention. In any such stroke, the rearward pull has the paddles full of water, while the return stroke has the paddles turned to offer least resistance to the flow of water past the swimmer. The paddles should remain under water at all times for best results. A crawl wherein the arms and hands are lifted out of the water runs the risk of losing the grip on the paddles when lifted out of the water. Much better control of the paddles is gained by having the hands and paddles below the surface of the water.

Figure 2:
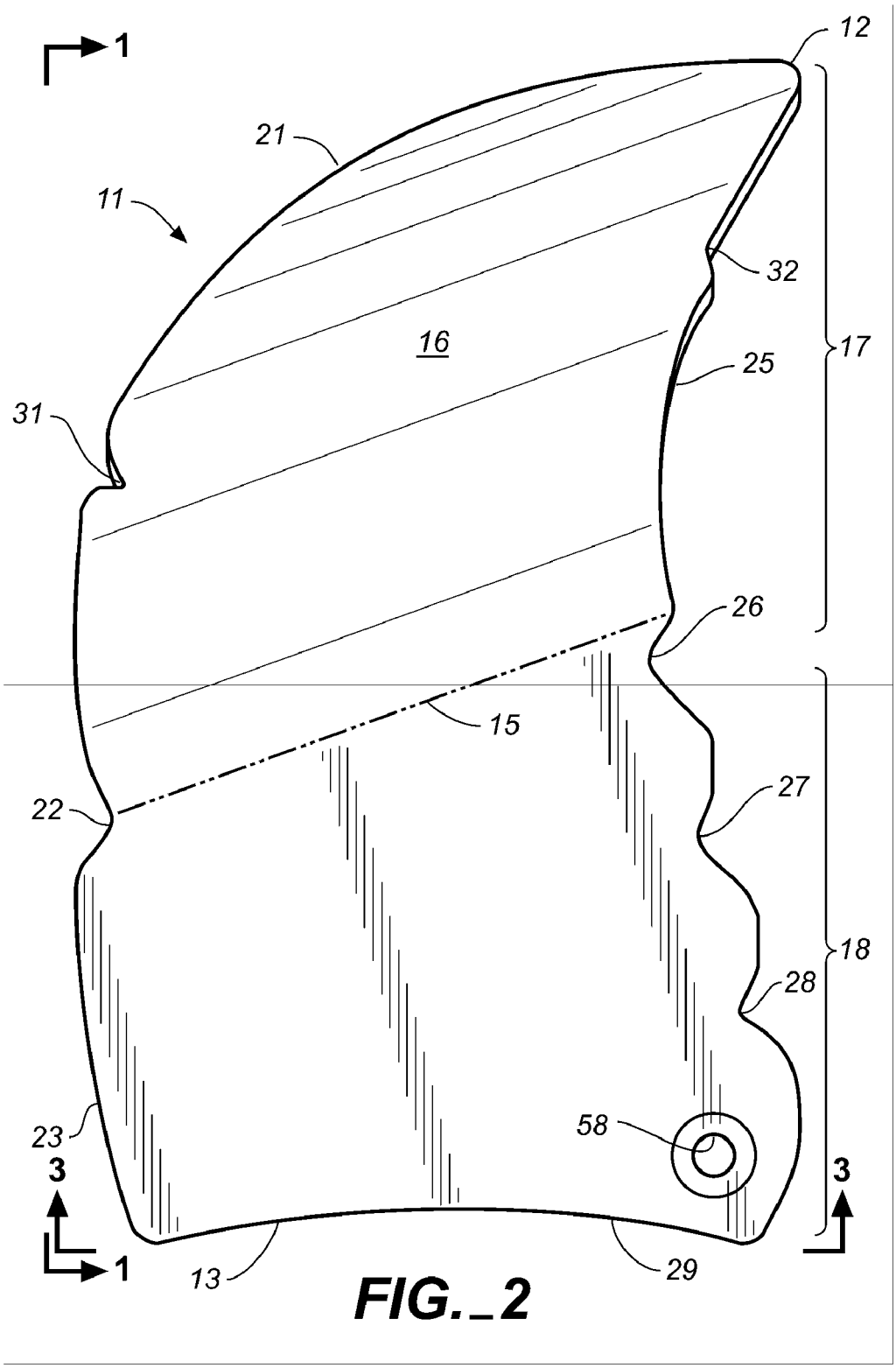
FIG. 2 is a top plan view of the right hand paddle.
Figure 3:
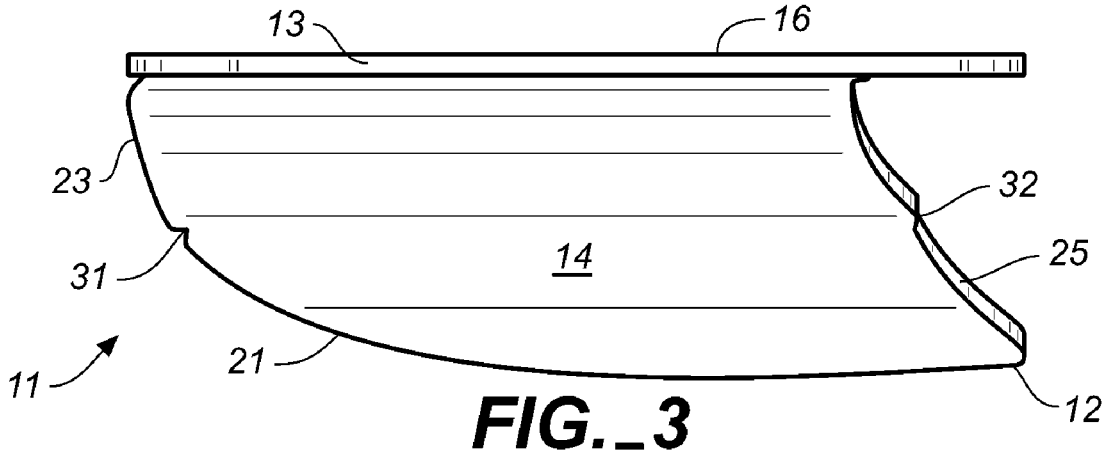
FIG. 3 is a rear elevation view of the right hand paddle.

The parameters of the invention are the parameters that make turtles better swimmers than humans under water. In the turtle fin, there is a gradual curvature downwardly from the extended fin and a more pronounced curvature towards the tip, with the tip pointed outwardly away from the turtle body. For ease of manufacture, I prefer to begin with a flat work piece and heat it to impart the desired curvature. As shown in FIG. 1, the curvature is somewhat rotational in that point 12 is downward and away from the body of the user, so that point 12 is furthest from the user's body, as best shown in FIG. 2. FIGS. 1 and 2 show a generally flat planar surface between the tail 13 of the paddle 111 to a line 15 (FIG. 2) approximately where the user grips the paddle by the user's thumb and little finger in notches 22 and 26. From tangent line 15, the paddle is curved, gradually at first and more curved towards point 12 to allow for cupping water as the user pulls the paddle rearwardly. While FIGS. 1–3 show a flat tail portion and a curved tip portion of paddle 11, in actual practice the heat of forming the paddle results in slight curvature in the zone 18 between tail 13 and line 15, and sharper curvature as tip 12 is approached. The radius of curvature is approximately sixteen inches at the tail portion (zone 18) of the paddle and about eight inches in the forward portion (zone 17). This allows the narrow point 12 to sharply displace water away from the user's body on the concave surface 14 of the paddle 11 in the power stroke. The curvature of the paddle at the tip end points the tip away and past the body of the user so that the head and body of the user are propelled forward in the water as the power stroke displaces water in a rearward direction. The wider tail end 13 follows the point 12 as the hand begins the power stroke, maximizing the amount of water displaced on the power stroke.

Although the precise radius selected for the curvature of the tip end and for the tail end is not critical, it is important that the arc formed at the tip end (zone 17) be of a substantially shorter radius that the arc formed at the tail end (zone 18) for optimum performance. The forward zone should have a radius of curvature in the range of 5 to 9 inches, and the aft zone should have a radius of curvature between 12 and 18 inches. Thus, the cup formed at the tip end must have a greater curvature than the curvature at the tail end to offer the greatest displacement in the power stroke.

FIGS. 1 and 3 also show elevational views of the thin paddle 11, which offers minimum resistance when the user turns the paddle to offer the least resistance to the water in moving forward for the next power stroke. The dimension between the inner surface 14 and outer surface 16 is preferably about ⅛ inch when used in ocean sea water. Of course, where used in denser water, such as the Dead Sea, a thicker paddle may be stronger and more appropriate. Similarly, in fresh water, a slightly thinner device may be suitable. I prefer to use acrylic sheets for fabricating the paddles of this invention, but the composition of the material used is not critical. Other thermoplastic materials may be used that are flexible enough to bend with the forces encountered without breaking. Metal or even wood may be used, so long as they can withstand the wear in the underwater environment where the paddles are used. Generally speaking, the thickness should be between 1/16 and ¼ inch. A suitable acrylic sheet is "Acrylite" sold by CYRO Industries, Rockaway, N.J. 07866. It comes in a wide variety of colors, which may serve a safety function when diving under water.

FIG. 2 is a top plan view of a right paddle in the medium configuration suitable for most divers. I have prepared three sizes of paddles: small, for persons with smaller hands; medium, for most users and described here in detail; and large, for those with large hands. The medium has a length of about 9 to 10 inches from tip to tail. The difference among the three sizes are that the small size is between about 8 and 9 inches in length tip to tail, and the large size is between about 10 and 111 inches tip to tail. The size may be more or less than these, without departing from the present invention. These sizes are intended to accommodate the hands of most users. The paddle shown in the drawings is the medium size.

Figure 4:
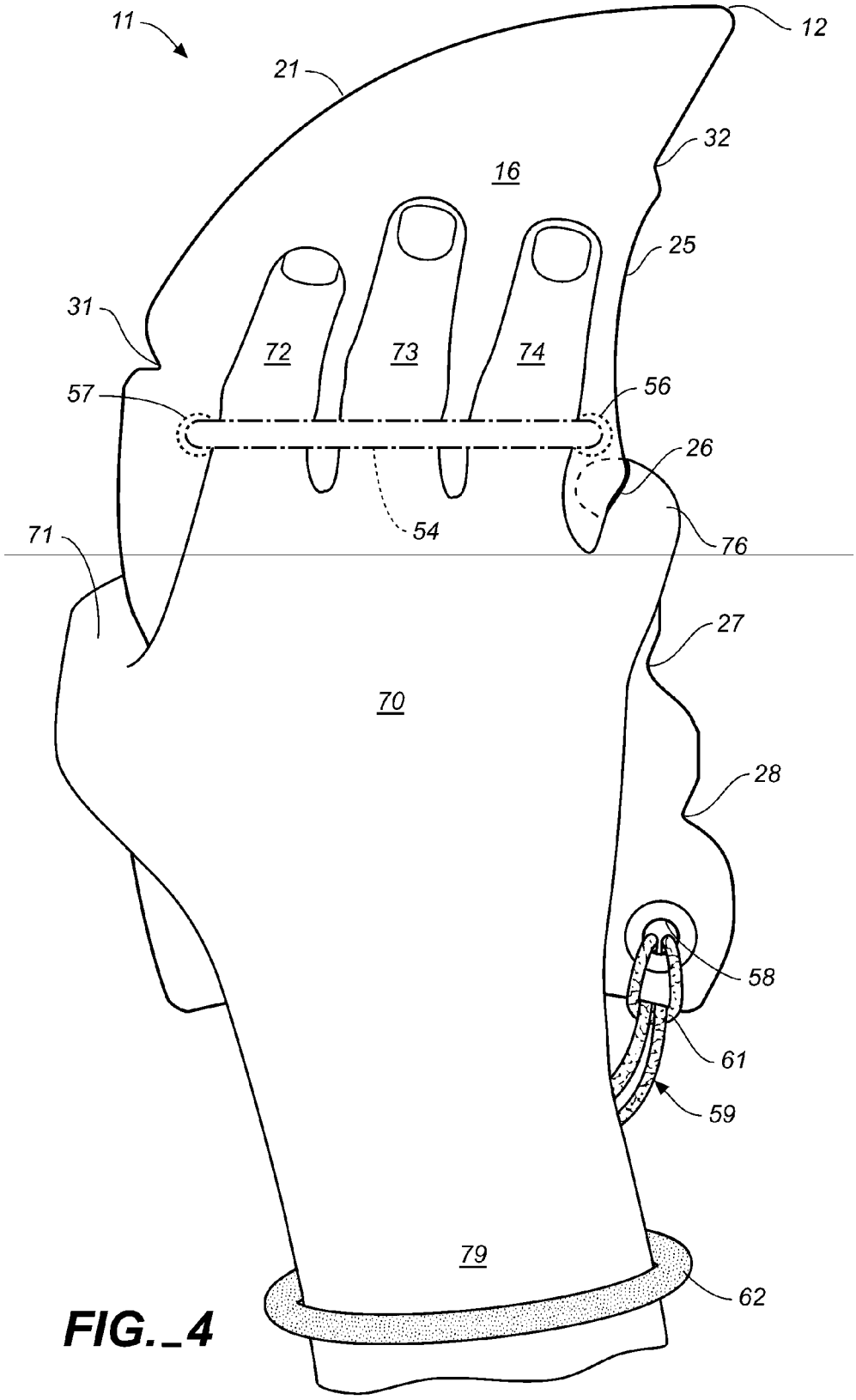
FIG. 4 is a top plan view of the right hand engaging the right paddle in the preferred embodiment.
Figure 5:
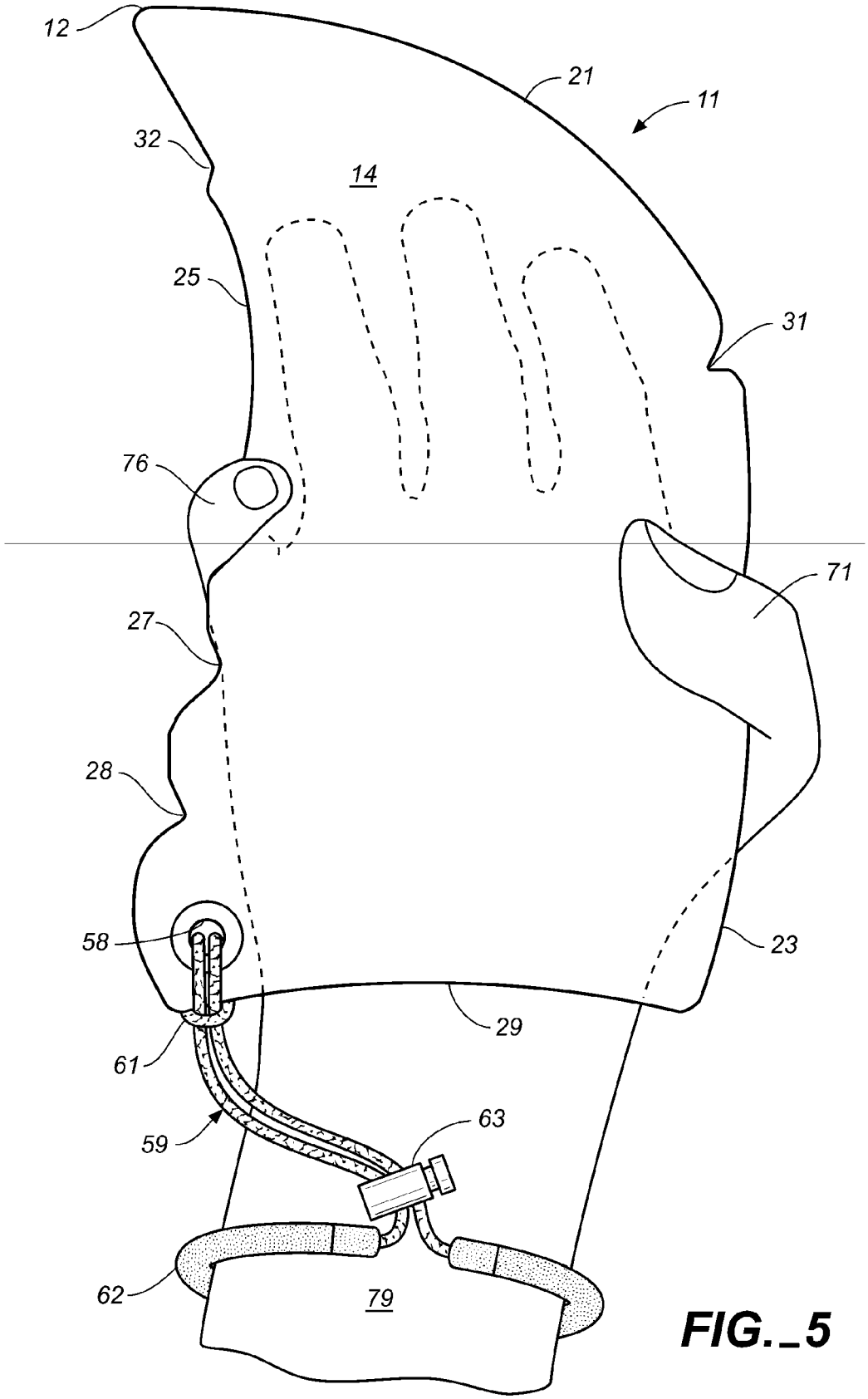
FIG. 5 is a bottom plan view of the right hand thumb and little finger engaging the right hand paddle in the preferred embodiment.
Figure 6:
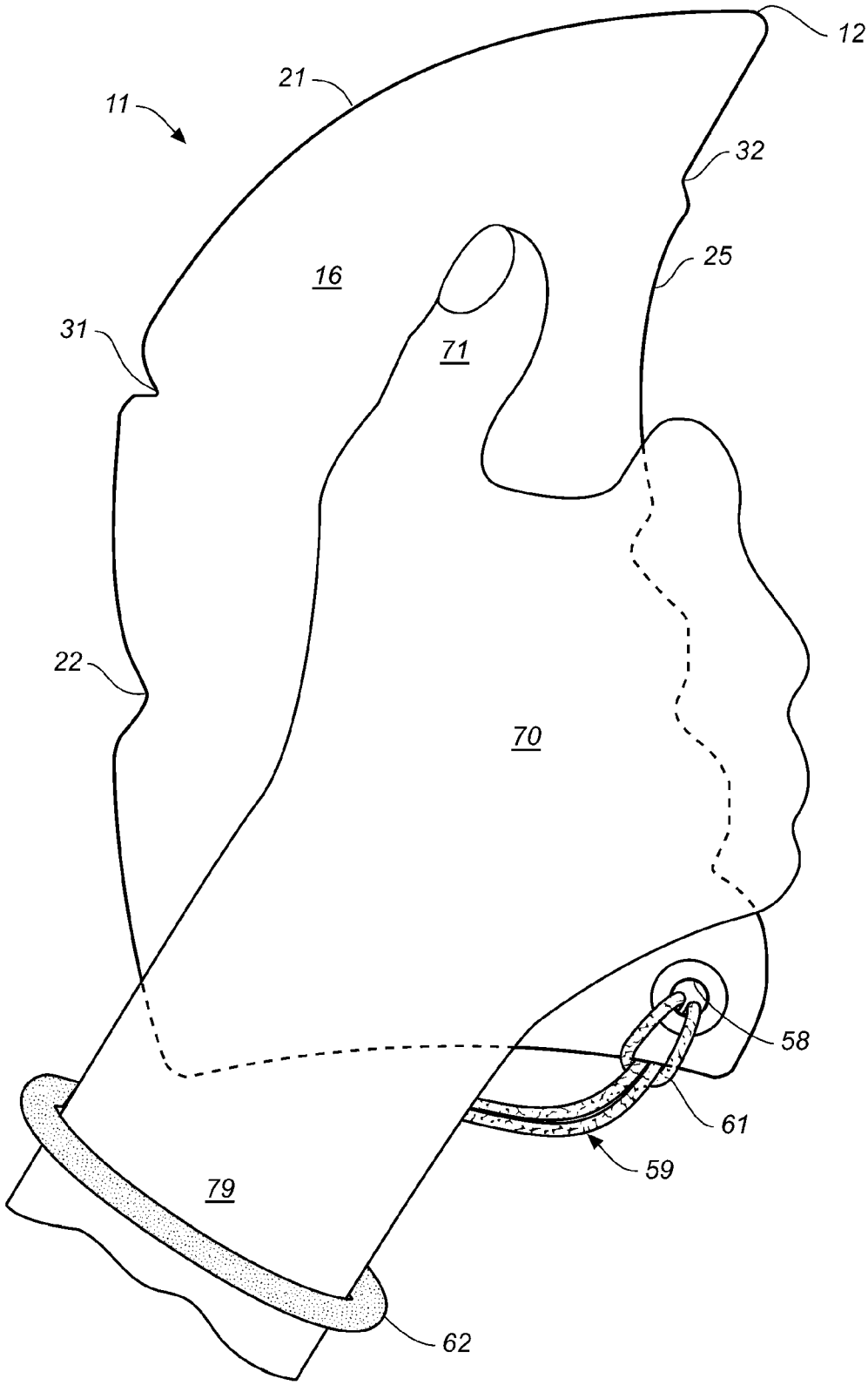
FIG. 6 is a top plan view of the right hand paddle with the hand in the "quick grip" mode.

FIGS. 4 to 6 show that tip 12 is pointed away from the body of the user at the beginning of the power stroke. The distance from tip 12 to tail 13 in the medium size of paddle is about 9.5 inches in the preferred embodiment. The paddle has a long curve 21 extending from tip 12 to a right thumb notch 22, which is about six inches behind point 12, measured along a line from tip 12 to tail 13, or at least half the length of paddle 11. The radius of the long curve 21 is about five inches. For optimum performance, the radius of curvature of the long curve 21 should be between four and six inches. The combination of the sharper curvature in zone 17 of FIG. 2 and the long curve 21 in FIG. 4 permits the power stroke to cup water gradually inward to the maximum width of the paddle 11 near the center of its length as the stroke begins for a minimum of turbulence. Turbulence is the enemy of efficiency in propulsion, as designers of screws to drive ships have learned. Avoiding turbulence as the paddle moves into the power stroke provides maximum efficiency in driving the power stroke.

The radius of the curvature at 23 of FIG. 2, aft of notch 22, is greater than the radius of curvature at long curve 21. This flattening out of the curve at 23 corresponds to the flattening out of the curve in zone 18 of FIG. 2, making the displacement at the heel or tail of the paddle greater than at the tip end 12.

The right hand of the user of the device of FIG. 2 has the thumb engage notch 22 and the little finger engages one of notches 26, 27 and 28, depending upon user preference. This allows the right hand to grip paddle 11 firmly between thumb (in notch 22) and little finger (in notch 27) normally. This choice is a matter of preference for the user, and depends upon a variety of factors, including build, weight, hand size and "feel" of the user, and whether or not strap 54 (FIG. 4) holds the hand strapped to the paddle.

While the grip shown in FIG. 4 is the normal one, at times a firmer grip is needed on the paddle. At those times, the little finger 76 is moved to notch 28, the ring finger 74 is moved to notch 27 and the middle finger 73 is moved to notch 26, leaving only index finger 72 without a notch to grasp. This version of the grip (not shown) is particularly appropriate where turbulent water requires a stronger grip.

FIG. 2 shows a slight curve in the tail 13 of paddle 11. As shown, the radius of curvature is about ten inches, but this curve is not essential to the invention. Edge 29 may be a straight line, a convex line or a concave line. It is largely cosmetic, since the displaced water exits from the cup of the inner surface 14 (FIG. 1) of paddle 111 during the power stroke.

FIG. 2 also shows notch 31 on the left side and notch 32 on the right side. These are largely cosmetic to suggest the shape of a turtle's fin. On occasion, a user may want to move the hand forward to a point closer to tip 12, in which case notches 31 and 32 may be functional for thumb and little finger, respectively, but this is not the normal grip.

Whether a strap is used or not is a matter of individual choice. Beginners and those who do not intend to remove the paddles will attach an elastic strap 54 (shown in dotted lines in FIG. 4) to the paddle. The strap has loops on each end secured to a metal pin (not shown). Each pin is inserted through holes 56 and 57 to the underside of paddle 11 and the swimmer's hand is placed securely under the strap 54 held in place by the pins. The forefinger, the middle finger and the ring finger are all held under the strap, while the thumb is in notch 22 and the little finger is in notch 27 to grip the paddle 11. The strap resembles straps in prior art devices.

At the rear of the paddle 11 in FIGS. 4, 5 and 6, a hole 58 may be drilled into through the paddle to hold a lanyard 59. Although strap 54 is not essential, for a user diving for abalone who must quickly let go of paddle 11 in order to manipulate the catch, as by prying it off a rock, lanyard 59 is useful to prevent loss of the paddle. Lanyard 59 has one end 61 secured to the paddle 11 at hole 58, and the other end 62 forming a loop to surround the wrist 79 of the user through slide 63. The user can adjust the loop by moving slide 63 along the line 59. The lanyard forms no part of the invention.

In operation, the user grips the paddle 11 of FIGS. 1–6 in the right hand, with right thumb in notch 22 and three fingers of the right hand in notches 26, 27 and 28. I prefer to have either a strap 54 across the back of each hand, or a wrist lanyard 59 around each of the user's wrists to prevent loss of the paddle should the user lose the grip in the notches for any reason. While both strap 54 and lanyard 59 are illustrated, one or the other, or neither, may be used according to user preference.

When the user chooses to dive, he or she takes a deep breath and dives with head down and arms forward of the head and initiates the power stroke by rotating the wrists outwardly and pulling sharply rearwardly with both hands, so that tip 12 points outwardly to displace water as the arms pull back and elbows bend as the paddle 11 propels the body forward through the water. At the lowest extension of the hands, the paddles naturally turn to become more or less flat against the user's thighs, when the return stroke begins. The paddles are kept next to the torso as the arms are raised with the paddles offering the least resistance to water flow along the path of the body through the water. With experience, a user can reach a depth of 40 feet with only three pulls of the power stroke, a feat impossible with the unaided hands.

When ascending from a dive, the whirling action I have described above is most useful for the fastest rise to get air. The body is naturally buoyant and naturally rises. The whirling by rotating the wrists allows a faster rise than natural buoyancy or a straight power stroke allows.

FIGS. 1–3 show the curvature laterally across the paddle 11. The heat involved in the manufacture of the paddles 11 causes the point 12, which extends below the lowermost margin of the paddle in FIG. 2, to droop. This droop is desirable, because it gives a slight curve downwardly from tangent line 15 to point 12, making a compound curve at the forward end of the paddle. This compound curvature makes the paddles more closely resemble the fins of a sea turtle, and improves performance in the initial draw in the power stroke where the point 12 moves outwardly and downwardly to cup water for maximum efficiency.

FIGS. 4 and 5 show the right hand paddle 11 grasped by the right hand in the normal swimming and diving configuration. Lanyard 59 is attached to paddle 11 at one end 61 in hole 58. The user's right hand 70 has thumb 71 engaging notch 22 (FIG. 2). Fingers 72, 73 and 74 rest on the top of paddle 11, and little finger 76 opposes thumb 71 and rests in notch 26 (FIG. 2) to grasp paddle 11 by thumb 71 and little finger 76. Point 12 extends outboard, away from the user's body, to displace water in the power stroke.

The point 12 is the intersection of two arcs measured generally from the notches 31 and 26. The long arc 21 has a radius of curvature of between four and six inches in the preferred embodiment. The shorter arc 25 has a similar radius of curvature, but it is shorter because it is on the outboard side and forms point 12 away from the body of the user. Arc 25 generally runs from little finger notch 26 to point 12.

FIG. 6 shows the hand 70 grasping paddle 11 in the quick retrieval mode of operation. When both paddles are released for under water work, and the diver seeks a quick ascent, each paddle may be grasped as in FIG. 6. A back and forth motion of the paddles so held, combined with the natural buoyancy of the body, allows a rapid ascent without taking time to do the normal thumb-little finger gripping of each paddle 11. The operation of FIG. 6 is not as effective for swimming as is the technique shown in FIGS. 4 and 5, but it allows paddle motion for water displacement, as contrasted to simply letting the paddles dangle from lanyards 59 streaming from the users wrists while ascending.

It is apparent that the paddles of this invention are versatile swim aids allowing rapid underwater movements in a variety of strokes. Forward movement is dramatically improved over strokes with the unaided hands of the swimmer or diver.

The dimensions and curvatures recited in these examples are merely illustrative to enable one skilled in the art to make and use the invention. They are not intended to limit the claims beyond what is expressly defined in the claims. Those skilled in the art can readily make alterations, in the number and locations of notches to allow the desired flexibility in use without deviating from this invention.

What is claimed is:

1. A pair of hand held paddles for underwater movement at high speed, consisting of a right hand paddle and a left hand paddle:

(1) the right paddle having a right side arc and a left side arc extending from a relatively flat base line near the right wrist of the user to a point forward of the extended fingers of the user and outboard of the right hand of the user, the right side arc having a shorter length and relatively slight curvature compared to the left side arc, extending from the base line to the forward point of the paddle and a left side arc of greater length and greater curvature than that of the right side arc, a notch in the left side arc for engagement by the right thumb of the user and at least one notch in the right side arc to engage at least one finger of the right hand of the user; a broad aft zone extending between the left and right side arcs from the base of the paddle to a line approximately across the paddle from the thumb notch to a right finger notch on which the palm of the right hand rests, said aft zone having a slight curvature longitudinally to accommodate the palm of the right hand, a forward zone between the right and left side arcs extending from the line between notches to the forward point, said zone having a curvature greater than that of the aft zone and increasing in curvature from said line to said point; and (2) the left paddle having a right side arc and a left side arc extending from a relatively flat base line near the left wrist of the user to a point forward of the extended fingers of the user and outboard of the left hand of the user, the left side arc having a shorter length and relatively slight curvature than the right arc, extending from the base line to the forward point of the paddle and a right side arc of greater length and greater curvature than that of the left side arc, a notch in the right side arc for engagement by the left thumb of the user and at least one notch in the left side arc to engage at least one finger of the left hand of the user; a broad aft zone extending between the left and right side arcs from the base of the paddle to a line approximately across the paddle from the thumb notch to a left finger notch on which the palm of the left hand rests, said aft zone having a slight curvature longitudinally to accommodate the palm of the left hand, a forward zone between the right and left side arcs extending from the line between notches to the forward point, said zone having a curvature greater than that of the aft zone and increasing in curvature from said line to said point; whereby greater underwater speed is attained.

2. A pair of hand held paddles as in claim 1 wherein the narrowing of each paddle in the forward zone in a planar view is a concave curve from approximately the midpoint of the length of each paddle to the point.

3. A device pair of hand held paddles as in claim 2 wherein radius of curvature of the forward zone of the paddles is between four and six inches.

4. A device pair of hand held paddles as in claim 1 wherein the forward zone of each paddle is at least half of the length of the paddle.

5. A device pair of hand held paddles as in claim 1 wherein the forward zone of curvature (2) has a radius of curvature of between 5 and 9 inches.

6. A device pair of hand held paddles as in claim 1 wherein the aft zone (3) has a radius of curvature of between 12 and 18 inches.

7. A device pair of hand held paddles as in claim 1 wherein each paddle has a thickness of between 1/16 and 1/4 inches.

8. A device pair of hand held paddles as in claim 1 wherein the tip point extends in a planar view outboard of the paddles to a greater extent than any other portion of the paddles.

9. A device pair of hand held paddles as in claim 1 wherein the point is also curved in both planar and elevational views.

10. A device pair of hand held paddles as in claim 1 wherein the radius of curvature of the longer arc from the thumb to the point of each paddle is between four and six inches as measured from the finger notch.

11. A pair of paddles as in claim 1, wherein (1) said right hand paddle includes in said forward zone a curvature downwardly and outwardly from line between the right thumb notch of the left side arc to a right side finger notch and the point laterally, with increasing curvature towards the point, whereby the forward zone has compound curvature both longitudinally and laterally away from the body of the user; and (2) the left hand paddle includes in said forward zone a curvature downwardly and outwardly from the line between the left thumb notch of the right side arc to a left side finger notch and the point laterally, with increasing curvature towards the point, whereby the forward zone has compound curvature both longitudinally and laterally away from the body of the user.

* * * * *